US010851640B2

(12) United States Patent
Gillan

(10) Patent No.: US 10,851,640 B2
(45) Date of Patent: Dec. 1, 2020

(54) NONSTOP TRANSITION FROM ROTARY DRILLING TO SLIDE DRILLING

(71) Applicant: Nabors Drilling Technologies USA, Inc., Houston, TX (US)

(72) Inventor: Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 244 days.

(21) Appl. No.: 15/939,927

(22) Filed: Mar. 29, 2018

(65) Prior Publication Data

US 2019/0301273 A1 Oct. 3, 2019

(51) Int. Cl.

| | |
|---|---|
| ***E21B 44/04*** | (2006.01) |
| ***E21B 3/02*** | (2006.01) |
| ***E21B 7/04*** | (2006.01) |
| ***E21B 47/00*** | (2012.01) |
| ***E21B 4/02*** | (2006.01) |
| ***E21B 47/06*** | (2012.01) |
| ***E21B 47/024*** | (2006.01) |
| ***E21B 7/06*** | (2006.01) |

(52) U.S. Cl.

CPC ..... *E21B 44/04* (2013.01); *E21B 3/02* (2013.01); *E21B 7/04* (2013.01); *E21B 4/02* (2013.01); *E21B 7/067* (2013.01); *E21B 47/00* (2013.01); *E21B 47/024* (2013.01); *E21B 47/06* (2013.01)

(58) Field of Classification Search

CPC ..... E21B 7/04

See application file for complete search history.

(56) References Cited

U.S. PATENT DOCUMENTS

| | | | | |
|---|---|---|---|---|
| 6,978,850 | B2 | 12/2005 | Sawyer | |
| 7,096,979 | B2 | 8/2006 | Haci et al. | |
| 7,802,637 | B2 | 9/2010 | Aronstam et al. | |
| 7,931,098 | B2 | 4/2011 | Aronstam et al. | |
| 8,672,055 | B2 | 3/2014 | Boone et al. | |
| 8,939,233 | B2 | 1/2015 | Edbury et al. | |
| 8,967,296 | B2 | 3/2015 | Downton et al. | |
| 9,309,760 | B2 | 4/2016 | Haci et al. | |
| 9,404,307 | B2 | 8/2016 | Maidla | |
| 9,428,961 | B2 | 8/2016 | Benson et al. | |
| 9,470,052 | B2 | 10/2016 | Edbury et al. | |
| 9,631,477 | B2 | 4/2017 | Harmer et al. | |
| 9,784,035 | B2 | 10/2017 | Boone et al. | |
| 9,784,089 | B2 | 10/2017 | Boone et al. | |
| 9,792,571 | B1 | 10/2017 | Mandava et al. | |
| 9,879,518 | B2 | 1/2018 | May | |
| 2004/0222023 | A1* | 11/2004 | Haci | E21B 7/068 175/61 |
| 2013/0032407 | A1* | 2/2013 | Edbury | E21B 7/06 175/61 |
| 2016/0341027 | A1* | 11/2016 | Kyllingstad | E21B 7/04 |

* cited by examiner

*Primary Examiner* — Tara Schimpf
*Assistant Examiner* — Dany E Akakpo
(74) *Attorney, Agent, or Firm* — Haynes and Boone, LLP

(57) ABSTRACT

Systems, devices, and methods for transitioning from a rotary drilling operation to a slide drilling operation on a drilling rig include rotary drilling a borehole in a subterranean formation by rotating a bottom hole assembly (BHA) on a drill string driven by a top drive and determining a trapped torque in a drill string. While maintaining weight on bit at the BHA, the drill string may be rotated in reverse to remove the trapped torque, and a slide drilling process may be performed without raising the bit from the bottom of the borehole.

21 Claims, 5 Drawing Sheets

NONSTOP TRANSITION FROM ROTARY DRILLING TO SLIDE DRILLING

TECHNICAL FIELD

The present disclosure is directed to systems, devices, and methods for transitioning from rotary drilling to slide drilling on a drilling rig. More specifically, the present disclosure is directed to systems, devices, and methods for detecting and addressing torque buildup in a drilling rig between rotary drilling and slide drilling operations.

BACKGROUND OF THE DISCLOSURE

Underground drilling involves drilling a bore through a formation deep in the Earth using a drill bit connected to a drill string. Two common drilling methods, often used within the same hole, include rotary drilling and slide drilling. Rotary drilling typically includes rotating the drilling string, including the drill bit at the end of the drill string, and driving it forward through subterranean formations. This rotation often occurs via a top drive or other rotary drive means at the surface, and as such, the entire drill string rotates to drive the bit. This is often used during straight runs, where the objective is to advance the bit in a substantially straight direction through the formation.

Slide drilling is often used to steer the drill bit to effect a turn in the drilling path. For example, slide drilling may employ a drilling motor with a bent housing incorporated into the bottom-hole assembly (BHA) of the drill string. The top side of the bent housing is commonly referred to as the "high side." A directional driller may attempt to steer the wellbore by pointing the high side of the bent motor in a predetermined direction, and holding that direction as consistently as possible. During typical slide drilling, the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

During rotary drilling, an amount of torque imparted into the steel drill string is used to overcome bore friction and drag in the wellbore. This amount of torque, sometimes referred to as "trapped torque," exists between the surface drive equipment, such as a top drive, and the drill bit. This trapped torque is the result of a lag between rotation at the surface and rotation at the drill bit. For long drill strings, the drill bit rotation may lag the surface rotation of the drill string by many revolutions, resulting in a substantial amount of trapped torque.

However, slide drilling with a drill string having trapped torque can impact the accuracy of the slide direction. For example, if a directional driller simply continues from rotary drilling straight into slide drilling, the trapped torque may seek to unwind the drill string back to its normal, un-torqued configuration. Since the upper end of the drill string is locked into the top drive, the only way these torque forces can dissipate is to travel downward toward the bit and unwind at the motor and bit end of the drill string. This causes the motor to rotate and turn clockwise and can make control of the high side of the motor impossible for the directional driller.

Conventional systems release the trapped torque physical raising and lowering the drill string in the wellbore, while rotating the drill string. Releasing the trapped torque in this manner is commonly referred to as "working the pipe." That is, before any slide drilling, the pipe may be raised and lowered multiple times while rotating it to remove trapped torque and so to render the directional motor steerable without uncontrolled drill string torque interference.

Unfortunately, working the pipe causes nonproductive time on a drilling rig because the bit is not on bottom drilling new wellbore. The period of working the pipe can be up to 5 minutes or so before each section of slide drilling. Some exemplary directional wells can have 80 to 100 or more such slide drilling intervals. These time periods of working the pipe to remove trapped torque can create inefficiencies in the drilling process, resulting in less efficient drilling processes and bit progression.

What is needed is a system that can reduce or eliminate the time lost by working the pipe. The present disclosure is directed to addressing one or more shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
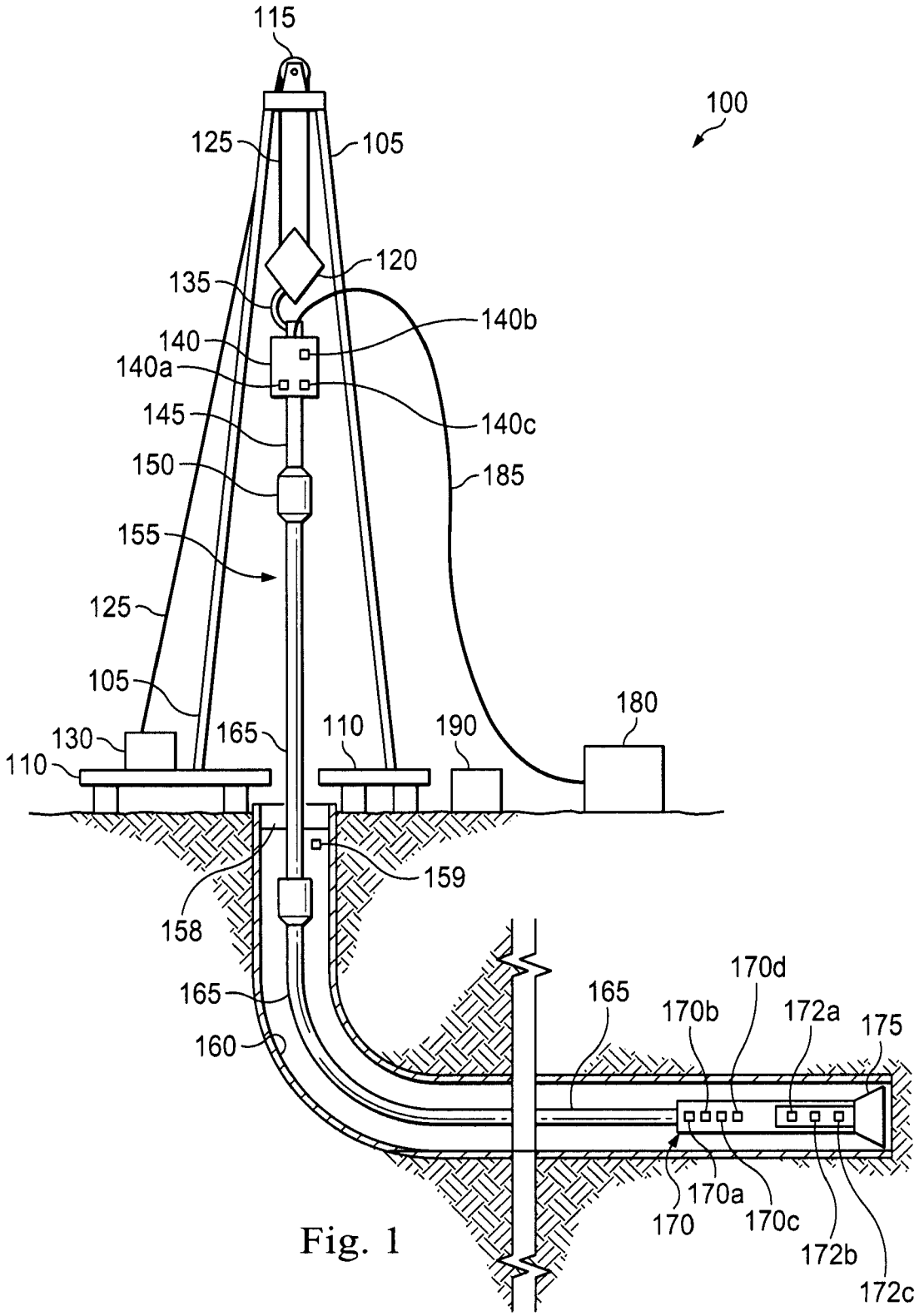
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods described herein remove trapped torque between a rotary drilling process and a slide drilling process while reducing or eliminating the need to work the pipe. That is, the systems and methods remove trapped torque while reducing or eliminating the need to lift a drill bit from the bottom of a borehole.

In some implementations, the systems and methods herein automatically determine an angular rotational displacement representative of trapped torque while rotary drilling. They may then rotate the top drive in reverse by the amount of the rotational displacement to remove the trapped torque before slide drilling. Reversing the top drive rotation direction to remove trapped torque may reduce or eliminate the need to work the pipe by physically raising and lowering the drill string. This may allow a rig operator to transition from rotary drilling to slide drilling without lifting the bit from the bottom of the wellbore, and may result in increased drilling speeds, reducing drilling costs, and improving overall rig efficiency.

In some implementations, the systems and methods described herein calculate a rotational displacement to remove the trapped torque using data detected and obtained during a rotary drilling process. Based on the calculated rotational displacement, the system may determine the amount of reverse rotation required to reduce or remove trapped torque, so that the slide drilling process may maintain its accuracy. The rotational displacement may be calculated using rotational torque detected at a top drive during the rotary drilling process. Some of the systems and implementations described in this present disclosure utilize existing sensors on the drilling rig without requiring new sensor systems to be added for the purpose of determining the amount of reverse rotation needed to remove the trapped torque.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig. In addition to the advantages described above, the systems and methods herein may reduce wear and tear on hoisting equipment, decreasing overall rig operating costs.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. For the purpose of slide drilling the drill string may include a down hole motor with a bent housing or other bend component, operable to create an off-center departure of the bit from the center line of the wellbore. The direction of this departure in a plane normal to the wellbore is referred to as the toolface angle or toolface. The drill bit 175, which may also be referred to herein as a "tool," or a "toolface," may be connected to the bottom of the BHA 170 or otherwise attached to the drill string 155. One or more pumps 180 may deliver drilling fluid to the drill string 155 through a hose or other conduit, which may be connected to the top drive 140. In some implementations, the one or more pumps 180 include a mud pump.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time or delayed time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the wellbore 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190. The controller 190 may include at least a processor, a memory, and a communication device. The memory may include a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory may include a non-transitory computer-readable medium. The memory may store instructions. The instructions may include instructions that, when executed by the processor, cause the processor to perform operations described herein with reference to the controller 190 in connection with embodiments of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor of the controller 190 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the controller 190 as shown in FIG. 1 above. The processor may also be implemented as a combination of computing devices, e.g., a combination of a DSP and a microprocessor, a plurality of microprocessors, one or more microprocessors in conjunction with a DSP core, or any other such configuration.

The communication device of the controller 190 may allow the controller 190 to send and receive signals, instructions, and code from other components of the drilling rig. The controller 190 may be configured to control or assist in the control of one or more components of the apparatus 100. For example, the controller 190 may be configured to transmit operational control signals to the drawworks 130, the top drive 140, the BHA 170 and/or the one or more pumps 180. In some implementations, the controller 190 may be a stand-alone component. The controller 190 may be disposed in any location on the apparatus 100. Depending on the implementation, the controller 190 may be installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. In other implementations, the controller 190 is disposed remotely from the drilling rig. The controller 190 may be configured to transmit the operational control signals to the drawworks 130, the top drive 140, the BHA 170, and/or the one or more pumps 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor 170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a* may include both static annular pressure (pumps off) and active annular pressure (pumps on).

Figure 2:
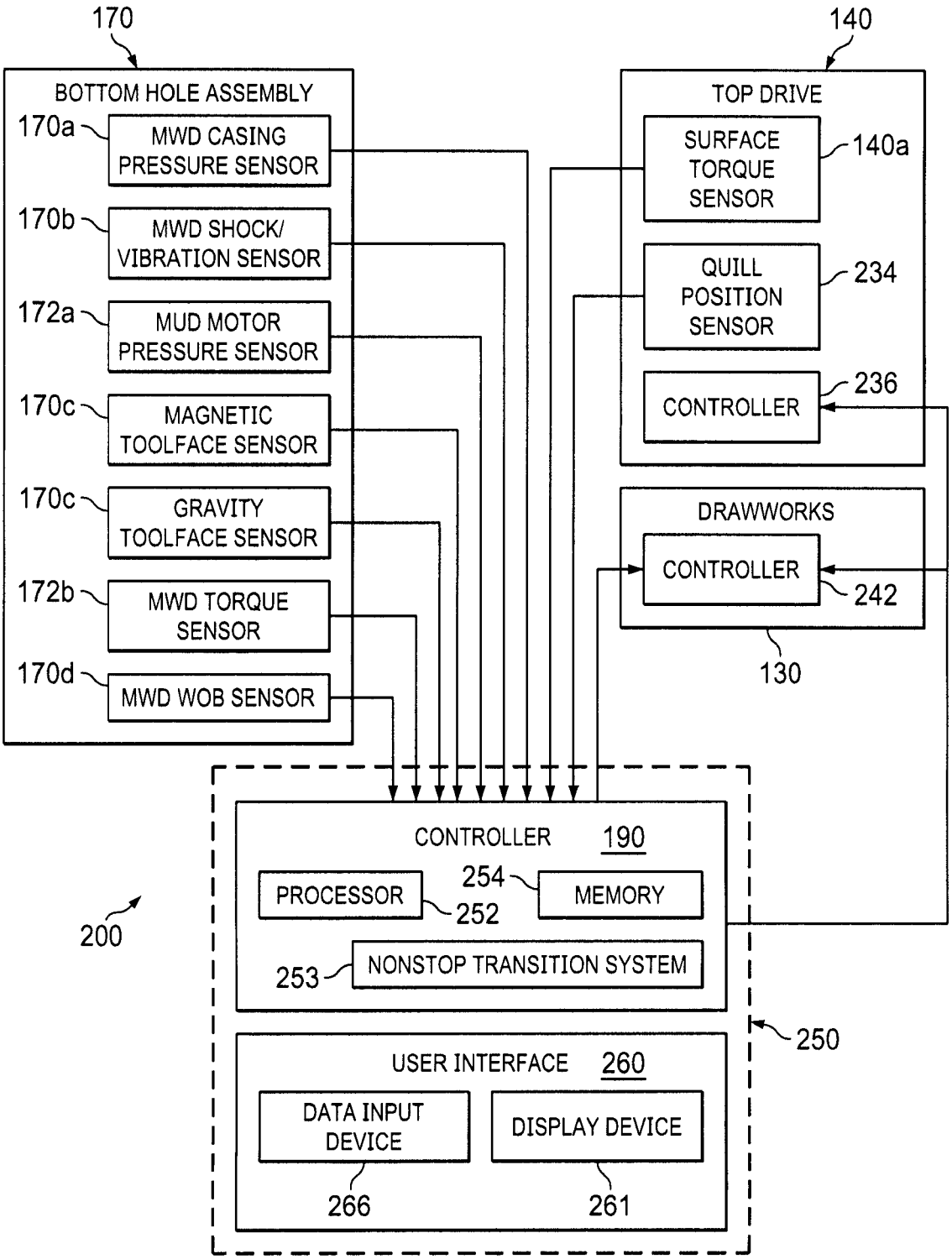
FIG. 2 is a schematic of an exemplary sensor and control system according to one or more aspects of the present disclosure.

The controller 190 may include a nonstop transition system 253 (as shown in FIG. 2). The nonstop transition system 253 may be part of the controller 190 or may be a separate component in communication with the controller 190. For the purpose of clarity, the controller 190 and the nonstop transition system 253 may be referred to interchangeably. In some implementations, the controller 190 may be configured to control the operation of various systems on the apparatus 100 in relation to the nonstop transition system 253. For example, in response to a detected and stored torque reading and/or an input from the drilling operator, the nonstop transition system 253 may brake the top drive 140, reverse the direction of the top drive, and rotate the drill string in reverse for a determined number of rotations to remove trapped torque from the drill string. The controller 190 may also be configured to communicate prompts, status information, sensor readings, and other information to an operator, for example, on a user interface such as user interface 260 of FIG. 2. The controller 190 may communicate via wired or wireless communication channels.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

Returning to FIG. 1, the apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172.

The apparatus 100 may additionally or alternatively include a toolface sensor 170*c* configured to detect the current toolface orientation. In some implementations, the toolface sensor 170*c* may be or include a conventional or future-developed magnetic toolface sensor which detects toolface orientation relative to magnetic north. Alternatively or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that may be based on active and static hook load) (e.g., one or more sensors installed somewhere in the load path mechanisms to detect and calculate WOB, which may vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

Referring to FIG. 2, illustrated is a block diagram of a sensor and control system 200 according to one or more aspects of the present disclosure. The sensor and control system 200 includes the controller 190, the bottom hole assembly (BHA) 170, the top drive 140, and the drawworks 130. The sensor and control system 200 may be implemented within the environment and/or apparatus shown in FIG. 1.

As described above, the controller 190 may include a processor 252 and a memory 254, as described herein with reference to FIG. 1. In addition, the controller 190 includes the nonstop transition system 253. Depending upon the implementation, the nonstop transition system 253 may form a part of or be stored within the memory 254, and may be executable by the processor 252.

The user interface 260 and the controller 190 may be discrete components that are interconnected via wired or wireless devices. Alternatively, the user interface 260 and the controller 190 may be integral components of a single system forming a larger controller, referenced herein by the number 250, as indicated by the dashed lines in FIG. 2.

The sensor and control system 200 may also include the nonstop transition system 253 as shown in FIG. 2. In the implementation shown, the nonstop transition system 253 is a module, a subcontroller, or other component forming a part of the controller 190. Other implementations include the nonstop transition system 253 in communication with, but disposed separately and apart from the controller 190. Although the nonstop transition system 253 may be a separate component from the controller 190 in some implementations, for the sake of clarity, the nonstop transition system 253 will be discussed as a part of the controller 190 below. The nonstop transition system 253 may be connected to the sensor systems of the sensor and control system 200 and may be configured to determine or calculate a trapped torque, a rotational displacement, or other parameter indicative of an offset between a rotational position of the top drive 140 and the toolface angle of the drill bit 175.

The user interface 260 may include a data input device 266 for user input of one or more toolface set points, other set points, limits, and other input data. For example, the user interface 260 may be used to control a rotary drilling process and/or a slide drilling process. The data input device 266 may include a keypad, voice-recognition apparatus, dial, button, switch, slide selector, toggle, joystick, mouse, data base and/or other conventional or future-developed data input device. The data input device 266 may support data input from local and/or remote locations. Alternatively, or additionally, the data input device 266 may include devices for user-selection of predetermined toolface set point values or ranges, such as via one or more drop-down menus. The toolface set point data may also or alternatively be selected by the controller 190 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a display device 261 arranged to present sensor results, prompts to a controller, calculated trapped torque values, measured or sensed rotational torque values, rotational displacements, drilling rig visualizations, as well as other information. The user interface 260 may visually present information to the user in visual form, such as textual, graphic, video, or other form, or may present information to the user in audio or other sensory form. In some implementations, the display device 261 is a computer monitor, an LCD or LED display, table, touch screen, or other display device. The user interface 260 may include one or more selectable icons or buttons to allow an operator to access information and control various systems of the drilling rig. In some implementations, the display device 261 is configured to present information related to trapped torque or rotational displacement to an operator.

In some implementations, the sensor and control system 200 may include a number of sensors, including those described above with reference to FIG. 1. Although a specific number of sensors are shown in FIG. 2, the sensor and control system 200 may include more or fewer sensors than those disclosed. Furthermore, some implementations of the nonstop transition system 253 may include additional sensors not specifically described herein.

Still with reference to FIG. 2, the BHA 170 may include the MWD down hole annular pressure sensor 170*a* shown in FIG. 1. The casing pressure data detected via the MWD casing pressure sensor 212 may be sent via electronic signal to the controller 190 via wired or wireless transmission.

The BHA 210 may also include the MWD shock/vibration sensor 170*b* shown in FIG. 1. The shock/vibration data detected via the MWD shock/vibration sensor 214 may be sent via electronic signal to the controller 190 via wired or wireless transmission.

The BHA 210 may also include the mud motor pressure sensor 172*a* shown in FIG. 1. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include the toolface sensor 170*c* shown here as a magnetic toolface sensor 218 and a gravity toolface sensor 220 that are cooperatively configured to detect the current toolface. The magnetic toolface sensor may be or include a conventional or future-developed magnetic toolface sensor which detects toolface orientation relative to magnetic north. The gravity toolface sensor may be or include a conventional or future-developed gravity toolface sensor which detects toolface orientation relative to the Earth's gravitational field. In an exemplary implementation, the magnetic toolface sensor may detect the current toolface when the end of the wellbore is less than about 7° from vertical, and the gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor and/or gravity toolface sensor) may be sent via electronic signal to the controller 190 via wired or wireless transmission.

The BHA 210 may also include the MWD torque sensor 172*b* that is configured to detect a value or range of values for torque applied to the bit by the motor(s) of the BHA 170. The torque data detected via the MWD torque sensor 172*b* may be sent via electronic signal to the controller 190 via wired or wireless transmission.

The BHA 210 may also include the MWD WOB sensor 170*d* that is configured to detect a value or range of values for WOB at or near the BHA 170. The WOB data detected via the MWD WOB sensor 170*d* may be sent via electronic signal to the controller 190 via wired or wireless transmission.

The drawworks 130 may include a controller 242 and/or other devices for controlling feed-out and/or feed-in of a drilling line (such as the drilling line 125 shown in FIG. 1). Such control may include rotational control of the drawworks (in versus out) to control the height or position of the hook, and may also include control of the rate the hook ascends or descends.

The top drive 140 may include the surface torque sensor 140*a* that is configured to detect a value or range of the reactive torsion of the quill or drill string. The drive system 230 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 190 via wired or wireless transmission. The top drive 140 also includes a controller 236 and/or other devices for controlling the rotational position, speed, and direction of the quill or other drill string component coupled to the top drive 140 (such as the quill 145 shown in FIG. 1).

In some implementations, the nonstop transition system 253 of the controller 190 may be configured to control the drawworks 130 and the top drive 140 to reduce or eliminate trapped torque by rotating the surface end of the drill string in reverse prior to initiating a slide drilling process. More particularly, in some implementations, certain parameters of the top drive, such as rotational torque and speed, may be used to calculate rotational displacement which can remove trapped torque from a drill string without coming off the bottom of the wellbore. Using data analytics for example, the nonstop transition system 253 may generate a high density torque versus time graph from the instant that rotational energy is transferred to the drill string. The character of this graph may have a typical profile. It may include a sharp, almost vertical rise in torque applied to the drill string while all the frictional and drag forces in the wellbore are being engaged and overcome by the power and the top drive. This sharp rise will then break over and decrease to a close to steady-state value once the drill string has completely attained its rotation. While this occurs, the nonstop transition system 253 may store the graph, or values representative of the graph, to be drawn upon later such as prior to a slide drilling process. During this period of time that torque is ramping up, sensed or detected data may also indicate an equally high density rotational speed signal. The nonstop transition system 253 may analyze this RPM signal from time TO until the torque break over time or peak time T1, indicating that the drill string has fully attained rotation. During this time, the top drive 140 is imparting pure torque to the drill string to start it into rotational motion, but the drill string has not yet attained complete rotation because of inertia and friction.

The RPM versus time curve may mimic or follow a speed versus time XY graph. By integrating the area under the RPM graph, the nonstop transition system can determine the displacement (speed*time=distance). In some instances, the displacement is rotational and can be expressed as degrees, where one rotation is equal to 360°. Other units however may be used.

In one example, if the RPM over time integration provides a displacement of 1124°, this may be expressed as 1124÷360=3.12 revolutions or wraps. The drilling operator may then continue rotary drilling for 5 or 6 feet. This is common practice while the system waits for the survey at the last connection to be acquired and processed. If the drilling operator were to then receive the survey that indicates a slide drilling process may be advisable, then the nonstop transition system may operate to set the top drive speed to zero, and then into reverse mode, and rotate 3.12 revolutions in reverse. After which, the driller may immediately start the slide drilling interval without trapped torque interference, or without "working the pipe." This may be accomplished while maintaining the drill bit against the bottom of the wellbore. At the conclusion of the slide drilling process, the drawworks and top drive may be controlled to maintain the drill bit against the bottom of the wellbore, and the top drive RPM may be increased to the usual forward speed for rotational drilling.

In some implementations, the nonstop transition system 253 may be configured to determine rotational displacement in any of at least two different ways. For example, a first way to determine trapped torque may rely upon a rotational displacement calculation. A second way to determine trapped torque may rely upon a function of power applied to the drill string.

Figure 3:
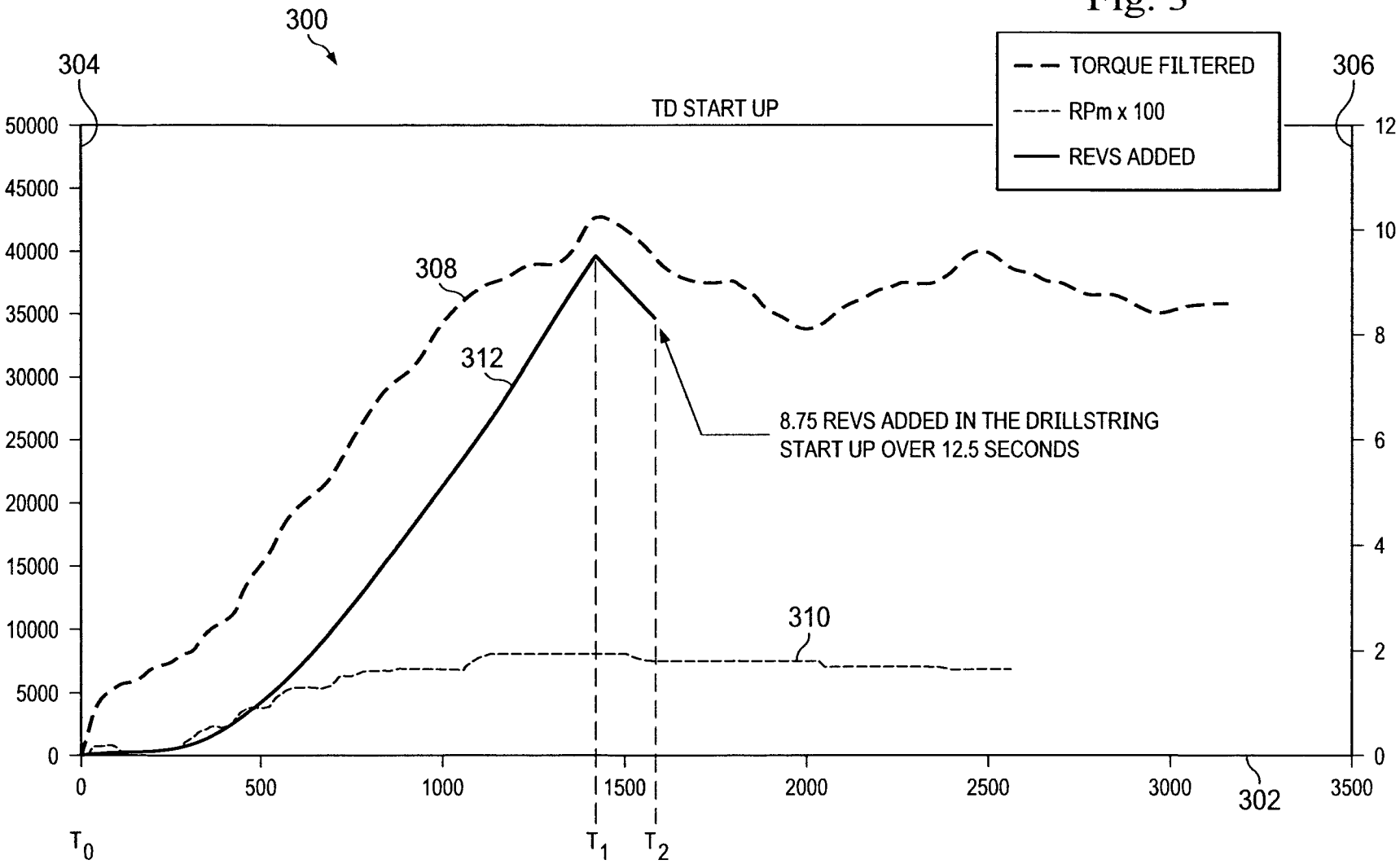
FIG. 3 is a chart showing selected operational parameters during an exemplary start-up process according to one or more aspects of the present disclosure.

FIG. 3 is an exemplary graph 300 showing windup torque representing trapped torque in a drill string during a startup of the top drive 140 as determined by the nonstop transition system 153. The graph 300 includes a horizontal time axis 302, a vertical torque axis 304, and a vertical revolutions axis 306. The time axis 302 may be in any units, but in this example, the units are increments of 0.008 seconds. In this example, the torque axis 304 may be in units of ft-lbs. The revolutions axis 306 is in units of revolutions.

A plotted line 308 represents torque detected at the top drive 140. This torque may be detected in real time by the surface torque sensor 140*a* or the torque sensor 232 described with reference to FIGS. 1 and 2. A plotted line 310 represents revolutions per minute (RPM) of the top drive itself. As can be seen, during a top drive startup process, the plotted line 308 includes a relatively sharp vertical rise in torque applied to the drill string from a startup time T0 to a peak time T1. The peak time T1 corresponds with the peak torque indicating the break mentioned above. Since the BHA at the end of the drill string will be the last portion of the drill string to rotate, the peak time T1 may represent the time that the BHA and/or the bit begins to rotate. As such, the peak time T1 may represent the time that the complete drill string begins rotation. After the peak time T1, the detected torque breaks over and decreases toward a close to steady-state value indicating that the drill string has completely attained its rotation. Accordingly, in the example graph 300 shown, the nonstop transition system identifies the peak time T1 as the location where the torque decreases or ends its vertical climb. As the plotted line 308 levels, the detected torque decreases as a result of the change in rotational acceleration and begins to approach a steady state. This steady-state represents the amount of trapped torque in the drill string.

This example includes a revolutions plotted line 312 representing the angular rotation difference between the top drive and the BHA or bit. The revolutions plotted line 312 is a function of torque and increases as the top drive rotates the upper segment of the drill string, and continues to increase so long as the BHA or bit rotates less than the top drive. At peak time T1 when the BHA or bit begins rotation, the torque may decrease as the rotational frictional resistance decreases from static friction to a dynamic friction. This sharp decrease in torque ends at time T2 where the torque value is shown by plotted line 308 starts to level into a more steady state value. Accordingly, the revolutions plotted line 312 also dips after the break at peak time T1. At time T2, the value of the revolutions according to the plotted line 312 represents the number of revolutions of trapped torque. This also represents the number of reverse revolutions needed in order to remove the trapped torque.

FIG. 3 also shows the plotted line 310 representing top drive RPMs for the reference of a user. Here, the value of the plotted line is shown on the vertical torque axis 304 as RPMs×100. This represents the actual RPM during the startup phase over the period of time on the time axis 302.

As indicated above, the trapped torque is the result of elasticity of the drill string, and may be represented as a function of displacement represented by speed or RPMs over time. That is, taking the integral of the plotted line 310 showing the torque curve between times T0 and T1 may yield the displacement. Each discrete RPM value over its time interval represents a rotational displacement in degrees. By summing all these discrete values from time T0 to time T1, we can calculate the amount of rotation in degrees applied to the drill pipe. By dividing that number of degrees by 360, we can arrive at the rotational displacement as a number of revolutions applied to the drill pipe in this start up event. Then, by reversing the rotational displacement, the trapped torque may be released.

Figure 4:
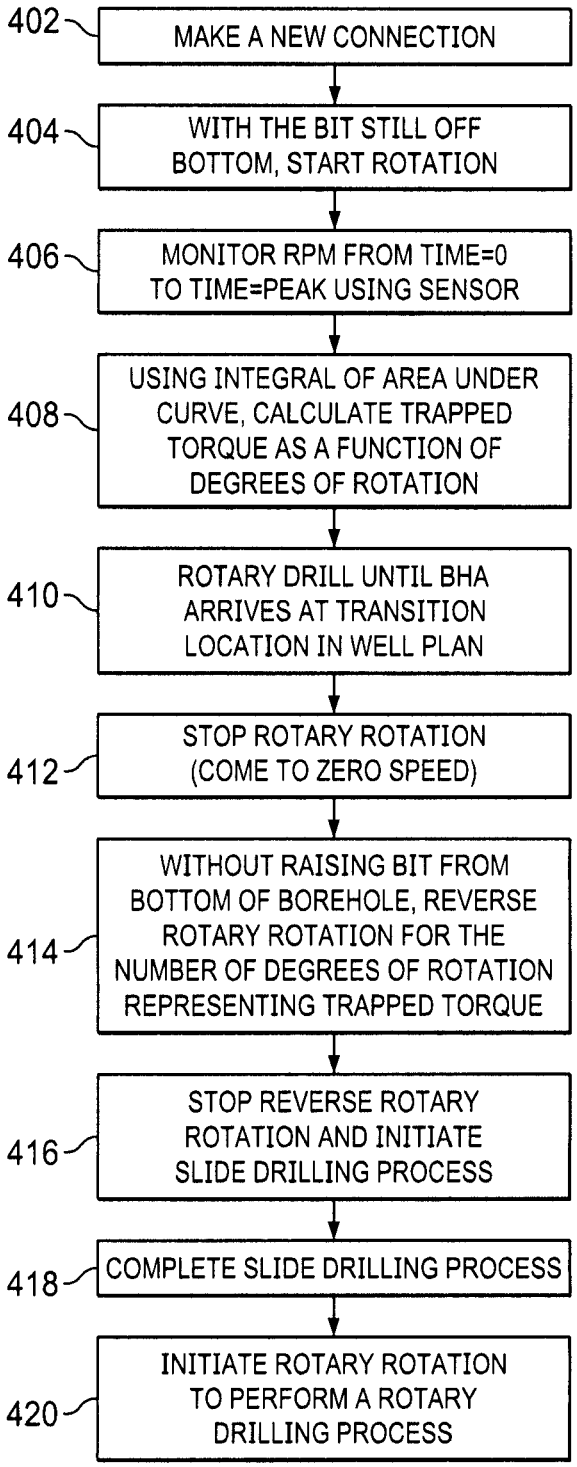
FIG. 4 is a flow chart diagram of a method of transitioning from a rotary drilling process to a slide drilling process without raising a BHA from a bottom of the bore hole according to one or more aspects of the present disclosure.

FIG. 4 shows an exemplary flowchart of a method 400 for determining and compensating for trapped torque during a nonstop transition from rotary drilling to slide drilling. The method may be carried out by the apparatus 100, including the sensor and control system 200. The controller 190 may receive data, process and track the data, and perform various calculations to determine the trapped torque in the apparatus 100. The method begins at a step 402, while making a new connection. The new connection may include disconnecting the top drive from the drill string, introducing a new pipe stand to the drill string and making up the connection, and then driving the new stand with the top drive.

At 404, with the bit still off the bottom of the borehole from making up the connection, the top drive begins to rotate the drill string. At 406, the sensor and control system 200 monitors the torque and the RPM of the top drive from time T0 to peak time T1 in FIG. 3. In some implementations, monitoring the RPM may be accomplished by the position sensor 234 or other sensor of the top drive 140. Monitoring the torque may be accomplished using the torque sensors about the apparatus 100. The nonstop transition system 153 monitors the torque trajectory to recognize the peak torque and to assign the peak location as the peak time T1. It may then continue to monitor the torque for the moment in time when the torque trajectory changes from its decreasing trajectory toward a steady state trajectory indicative of a steady state condition.

At 408, the nonstop transition system 253 may calculate the trapped torque as a function of degrees of rotation. In some implementations, this may be done by taking the integral of the RPM curve between time T0 to peak time T1 to determine the area under the curve. This calculated value may represent the trapped torque in the drilling system as a function of degrees of rotation, and may be plotted for example as revolution plotted line 312. Using this calculation method, the trapped torque may be represented by a rotational amount or measurement. For example, the nonstop transition system 253 may integrate the area under the RPM graph to determine rotational displacement, which may be expressed in degrees or other units. Using 360° or equivalent units per rotation, the nonstop transition system 253 may determine the number of revolutions of trapped torque in the drill string. In some implementations, the value for the plotted line 312 may be calculated in real-time based on the real-time detected torque.

At 410, the apparatus 100 may lower the BHA into contact with the bottom of the borehole and continue to rotary drill until the BHA arrives at the transition location of the well plan. In some implementations, the transition location may be determined far in advance before drilling begins. In other implementations, the transition location may be determined as late as the most recent connection makeup.

At 412, at the desired transition location, the nonstop transition system 253 of the controller 190 may stop rotary rotation. This may include stopping rotation of the top drive. Stopping rotary rotation may also be referred to as coming to zero speed.

At 414, without raising the bit from the bottom of the borehole (e.g., while maintaining weight on bit (WOB)), the nonstop transition system 253 of the controller 190 may reverse rotary rotation for the number of degrees of rotation representing trapped torque. This reverse rotation may be equivalent to the number of revolutions of trapped torque determined at 408.

At 416, after rotating in reverse for the number of revolutions of trapped torque determined at 408, the reverse rotary rotation may be stopped, and the slide drilling process may be initiated. This may include stopping rotation via the top drive, and utilizing mud pumps at the surface feeding a slurry to a mud motor disposed on the BHA. In this manner, the slide drilling process may occur.

At step 418, the slide drilling process may be completed, and the mud flow may be halted. Without raising the drill bit from the bore of the surface (e.g., while maintaining weight on bit), at 420, rotary rotation may again be initiated to perform a rotary drilling process.

Figure 5:
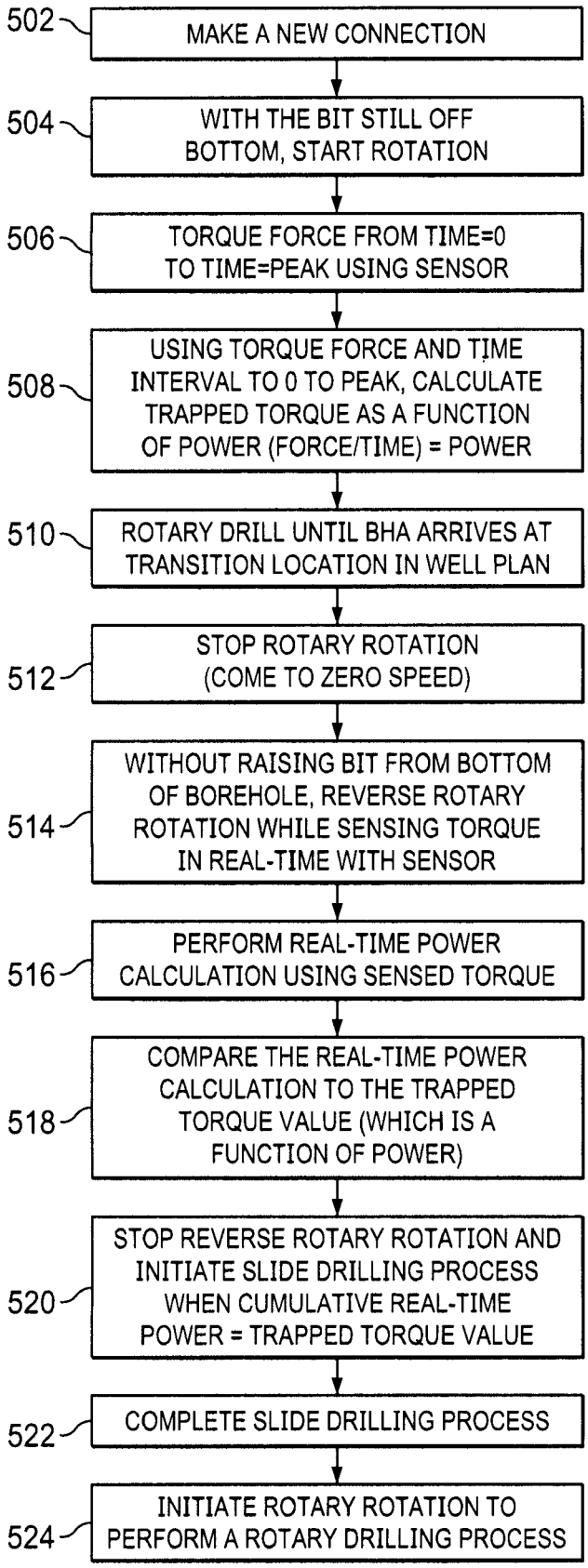
FIG. 5 is a flow chart diagram of a method of transitioning from a rotary drilling process to a slide drilling process without raising a BHA from a bottom of the bore hole according to one or more aspects of the present disclosure.

FIG. 5 shows another exemplary flowchart of a method 500 for determining and compensating for trapped torque during nonstop transition from rotary drilling to slide drilling. The method 500 however may rely on trapped torque as a function of power. Again, the method may be carried out by the apparatus 100 including the sensor and control system 200. The method 500 begins at a 502, while making a new connection. At 504, with the bit still off bottom from making up the connection, the top drive begins to rotate the drill string.

At 506, the nonstop transition system 253 monitors the detected torque from time T0 to peak time T1, as represented in FIG. 3. As indicated above, the torque measurement may be detected by one or more sensors on the top drive or at other locations throughout the apparatus. At 508, the nonstop transition system 253 may use the detected torque and the time interval between time T0 and peak time T1 to calculate trapped torque. Peak time T1 corresponds to when the detected torque is at its peak. In this implementation, the trapped torque may be determined as a function of power (force×displacement/time)=power. Torque is a force moving over a displacement, for instance a torque of 100 foot lbs is a force of 100 lb force moving through a foot length. The power calculated thus in horsepower can be readily converted into watts (1 horsepower=745.7 watts). The detected torque may be further monitored as the torque drops between peak time T1 and the time T2 to when the torque transitions toward a steady-state value. This trapped torque value as a function of power may then be stored for reference later.

At 510, the apparatus 100 may lower the BHA into contact with the bottom of the borehole and continue to rotary drill until the BHA arrives at the transition location of the well plan, in a manner similar to that described above with reference to 410.

At 512, at the desired transition location the nonstop transition system 253, the controller 190 may stop rotary rotation, bringing the top drive to zero speed. At 514, without raising the bit from the bottom of the borehole (e.g., while maintaining weight on bit), the nonstop transition system 253 of the controller 190 may reverse rotary rotation, while sensing torque in real time with a torque sensor of the sensor and control system 200. In some implementations, the torque sensor may be torque sensor 232 of the top drive 140. At 516, the nonstop transition system 253 may continue to perform real-time power calculations using the real-time sensed torque. As indicated at 518, the real-time power calculation may be compared to the trapped torque value, which may also be a function of power. This comparison may continue until the cumulative real-time power applied in reverse rotation equals the trapped torque power value, as indicated at 520. The real-time power applied in reverse equals the trapped torque power when the trapped torque in the drill string has been depleted.

At 522, after depleting the trapped torque from the drill string, the reverse rotation may be stopped, and the slide drilling process may be initiated in the manner described herein. At 524, after the slide drilling process is concluded, the nonstop transition system may initiate rotary rotation to perform the subsequent rotary drilling process without raising the bit from the bottom of the borehole (e.g., while maintaining weight on bit).

Although some examples described herein utilize data taken at a time T2 in FIG. 3 to determine the trapped torque, where time T2 corresponds to the time when the torque approaches a steady-state, other implementations utilize data taken over a period of time between the peak time T1 and the time when slide drilling is desired. Yet other implementations utilize data taken over a period of time between the time T2 and the time when slide drilling is desired. In these instances, the steady-state torque may be continuously monitored to provide an indication of the trapped torque utilizing the principles described herein.

Because the system described herein determines and removes the amount of trapped torque in the drill string prior to slide drilling, drilling process speeds may be increased since a user is not required to shake out or "work the pipe" prior to initiating a slide drilling process. This can result in increased drilling efficiencies, resulting in reduced operating costs and simplifying the drilling process.

In view of all of the above and the figures, one of ordinary skill in the art will readily recognize that the present disclosure introduces a system for transitioning from a rotary drilling operation to a slide drilling operation on a drilling rig, including: a top drive and a drill string having a bottom hole assembly (BHA). The drill string may be cooperatively connected to the top drive. The system also includes a controller in communication with the top drive and configured to: determine a rotational displacement introduced to the drill string while rotating the drill string and to determine trapped torque as a function of the rotational displacement; and prior to initiating a slide drilling process, generate a control signal to rotate the top drive in reverse for the determined rotational displacement to relieve the trapped torque from the drill string.

In some aspects, the controller is configured to determine a rotational displacement introduced during a time period from when the top drive begins rotating until a time that a detected torque approaches a steady state. In some aspects, the system includes a sensor associated with the top drive to detect the rotational displacement. In some aspects, the controller is configured to control the top drive to transition from a rotary drilling process to a slide drilling process while maintaining weight on bit. In some aspects, the controller is configured to calculate trapped torque as a function of degrees of rotation based on an integral of an RPM curve based on the top drive rotation during the time period. In some aspects, the system includes a sensor associated with the top drive to detect applied torque. In some aspects, the controller is configured to detect applied torque by determining when the top drive begins rotating and determining when the BHA begins rotating based on a peak in the detected applied torque.

The present disclosure also introduces a system for transitioning from a rotary drilling operation to a slide drilling operation on a drilling rig. The system may include a top drive and a drill string extending from the top drive and having a bottom hole assembly (BHA) disposed at a distal end of the drill string. The system also may include a sensor configured to detect applied torque on the drill string over a first period of time during a rotary drilling process and a controller in communication with the sensor and the top drive. The controller may be configured to: receive the detected applied torque from the sensor; determine trapped torque in the drill string as a function of power over the first period of time; and prior to initiating a slide drilling process, transmitting an instruction to the top drive to rotate in reverse until the trapped torque is removed from the drill string.

In some aspects, the controller is configured transmit an instruction to initiate a slide drilling process without lifting the BHA from a bottom of a borehole. In some aspects, the first period of time is the time period from when the top drive begins rotating until the time that the BHA rotates. In some aspects, the sensor is configured to detect torque in real time while the top drive rotates in reverse and the controller is configured to determine when the trapped torque is relieved. In some aspects, the controller is configured to stop reverse rotary rotation and initiate slide drilling when cumulative real-time power equals a value representative of the trapped torque. In some aspects, the controller is configured to control the top drive to transition from a rotary drilling process to a slide drilling process while maintaining weight on bit.

The present disclosure also introduces a method of transitioning from a rotary drilling operation to a slide drilling operation on a drilling rig, comprising: rotary drilling a borehole in a subterranean formation by rotating a bottom hole assembly (BHA) on a drill string driven by a top drive; determining a trapped torque in a drill string; while maintaining weight on bit at the BHA, rotating the drill string in reverse to remove the trapped torque; and performing a slide drilling process without relieving the weight on bit.

In some aspects, determining the trapped torque comprises determining applied torque during a startup process. In some aspects, the method may include detecting applied torque while rotating the drill string in reverse. In some aspects, the method may include comparing the detected applied torque to the determined trapped torque. In some aspects, the method may include stopping reverse rotation when the detected applied torque is equal to the determined trapped torque. In some aspects, determining the trapped torque comprises determining angular rotation during a startup process. In some aspects, the startup process includes a time period where the applied torque is zero to when the torque approaches a steady state. In some aspects, the method may include using an integral of an area under a curve to calculate the trapped torque as a function of angular rotation.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A system for transitioning from a rotary drilling operation to a slide drilling operation on a drilling rig, comprising:
- a top drive;
- a drill string having a bottom hole assembly (BHA), the drill string being cooperatively connected to the top drive; and
- a controller in communication with the top drive and configured to:
  - determine a rotational displacement introduced to the drill string while rotating the drill string and to determine trapped torque in the drill string as a function of the rotational displacement of the drill string due to the rotation of the top drive; and
  - prior to initiating a slide drilling process, generate a control signal to rotate the top drive in reverse for the determined rotational displacement to relieve the trapped torque from the drill string.

2. The system of claim 1, wherein the controller is configured to determine a rotational displacement introduced during a time period from when the top drive begins rotating until a time that a detected torque approaches a steady state.

3. The system of claim 1, further comprising a sensor associated with the top drive to detect the rotational displacement.

4. The system of claim 1, wherein the controller is configured to control the top drive to transition from a rotary drilling process to the slide drilling process while maintaining weight on bit.

5. The system of claim 1, wherein the controller is configured to calculate trapped torque as a function of degrees of rotation based on an integral of an RPM curve based on the top drive rotation during a time period from when the top drive begins rotating until a time that a detected torque approaches a steady state.

6. The system of claim 1, further comprising a sensor associated with the top drive to detect applied torque.

7. The system of claim 6, wherein the controller is configured to detect applied torque by determining when the top drive begins rotating and determining when the BHA begins rotating based on a peak in the detected applied torque.

8. A system for transitioning from a rotary drilling operation to a slide drilling operation on a drilling rig, comprising:
- a top drive;
- a drill string extending from the top drive and having a bottom hole assembly (BHA) disposed at a distal end of the drill string;
- a sensor configured to detect applied torque on the drill string over a first period of time during a rotary drilling process; and
- a controller in communication with the sensor and the top drive, the controller configured to:
  - receive the detected applied torque from the sensor;
  - determine trapped torque in the drill string as a function of power of the top drive over the first period of time; and
  - prior to initiating a slide drilling process, transmitting an instruction to the top drive to rotate in reverse until the trapped torque is removed from the drill string.

9. The system of claim 8, wherein the controller is configured transmit an instruction to initiate a slide drilling process without lifting the BHA from a bottom of a borehole.

10. The system of claim 8, wherein the first period of time is a time period from when the top drive begins rotating until a time that the BHA rotates.

11. The system of claim 8, wherein the sensor is configured to detect torque in real time while the top drive rotates in reverse and the controller is configured to determine when the trapped torque is relieved.

12. The system of claim 11, wherein the controller is configured to stop reverse rotary rotation and initiate slide drilling when cumulative real-time power equals a value representative of the trapped torque.

13. The system of claim 8, wherein the controller is configured to control the top drive to transition from the rotary drilling process to the slide drilling process while maintaining weight on bit.

14. A method of transitioning from a rotary drilling operation to a slide drilling operation on a drilling rig, comprising:
- rotary drilling a borehole in a subterranean formation by rotating a bottom hole assembly (BHA) on a drill string driven by a top drive;

determining a trapped torque in the drill string applied by the top drive during a startup process;

while maintaining weight on bit at the BHA, rotating the drill string in reverse to remove the trapped torque; and performing a slide drilling process without relieving the weight on bit.

15. The method of claim 14, wherein determining the trapped torque comprises determining applied torque during the startup process until a detected torque approaches a steady state.

16. The method of claim 15, comprising detecting applied torque while rotating the drill string in reverse.

17. The method of claim 16, comprising comparing the detected applied torque to the determined trapped torque.

18. The method of claim 17, comprising stopping reverse rotation when the detected applied torque is equal to the determined trapped torque.

19. The method of claim 14, wherein determining the trapped torque comprises determining angular rotation during a startup process.

20. The method of claim 19, wherein the startup process includes a time period extending from when applied torque is zero to when the torque approaches a steady state.

21. The method of claim 20, comprising using an integral of an area under a curve to calculate the trapped torque as a function of angular rotation.

* * * * *